US007147538B2

(12) United States Patent
Cano

(10) Patent No.: US 7,147,538 B2
(45) Date of Patent: Dec. 12, 2006

(54) CUSHION INSERT FOR STRAPS

(75) Inventor: Carlos Alberto Cano, Estado de Mexico (MX)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 212 days.

(21) Appl. No.: 10/465,529

(22) Filed: Jun. 19, 2003

(65) Prior Publication Data

US 2004/0259469 A1 Dec. 23, 2004

(51) Int. Cl.
*A41C 3/10* (2006.01)
*A41C 3/12* (2006.01)

(52) U.S. Cl. ..... 450/86; 450/88; 2/267; 2/338; 224/264

(58) Field of Classification Search ..... 450/86, 450/88, 1; 2/267, 268, 338, 336, 460, 326–333, 2/45, 52, 455; 224/642, 643, 264–266, 254, 224/660; 428/71, 72, 76, 174, 178, 194, 428/315.9, 318.6, 319.7, 448, 423.1, 447; 5/450, 480, 481, 909, 654
See application file for complete search history.

(56) References Cited

U.S. PATENT DOCUMENTS

| | | | | |
|---|---|---|---|---|
| 2,505,272 | A | | 4/1950 | Blalock et al. |
| 2,587,101 | A | | 2/1952 | Blalock et al. |
| 2,654,887 | A | | 10/1953 | Hookstratten |
| 2,763,866 | A | | 9/1956 | Anderson |
| 3,025,859 | A | | 3/1962 | Rosenberg |
| 3,050,734 | A | | 8/1962 | Dopyera |
| 3,229,694 | A | | 1/1966 | Koropp |
| 3,588,913 | A | | 6/1971 | Ewing |
| 4,100,924 | A | | 7/1978 | Rosenberg |
| 4,472,838 | A | | 9/1984 | Pompa |
| 4,575,874 | A | | 3/1986 | Johnson |
| 4,612,935 | A | | 9/1986 | Greifer |
| 4,795,399 | A | | 1/1989 | Davis |
| 4,795,400 | A | | 1/1989 | Greenberg |
| 4,887,318 | A | | 12/1989 | Weinreb |
| 4,945,571 | A | | 8/1990 | Calvert |
| 4,945,576 | A | | 8/1990 | Melton |
| 5,162,015 | A | | 11/1992 | Otani |
| 5,165,113 | A | | 11/1992 | Hyams et al. |
| 5,195,948 | A | | 3/1993 | Hill et al. |
| 5,201,078 | A | | 4/1993 | Melton |
| 5,240,538 | A | | 8/1993 | Hyams et al. |
| 5,269,720 | A | | 12/1993 | Moretz et al. |
| 5,388,743 | A | | 2/1995 | Silagy |
| 5,445,858 | A | * | 8/1995 | Nwoko ..... 428/71 |
| 5,474,487 | A | | 12/1995 | Roush et al. |
| 5,507,682 | A | | 4/1996 | Grahammer |
| 5,558,556 | A | | 9/1996 | Froehlich |
| 5,566,871 | A | | 10/1996 | Weintraub |
| 5,577,648 | A | | 11/1996 | Sason et al. |

(Continued)

FOREIGN PATENT DOCUMENTS

| | | |
|---|---|---|
| MX | 003368 | 3/1994 |

(Continued)

*Primary Examiner*—Gloria M. Hale
(74) *Attorney, Agent, or Firm*—Ohlandt, Greeley, Ruggiero & Perle, L.L.P.

(57) ABSTRACT

A cushion insert having a cushion material, a support member, and a cover is provided. The cushion material is enclosed by an upper ply and a lower ply. The support member is disposed on the upper ply. The cover secures the support member to the upper ply so that the support member restrains expansion of the cushion material toward the upper ply.

20 Claims, 2 Drawing Sheets

U.S. PATENT DOCUMENTS

| | | | | |
|---|---|---|---|---|
| 5,614,303 | A | 3/1997 | Baigas, Jr. | |
| 5,626,507 | A | 5/1997 | Gillen | |
| 5,765,735 | A | 6/1998 | Kimchi et al. | |
| 5,803,792 | A | 9/1998 | Roush et al. | |
| 5,913,413 | A | 6/1999 | Huyck | |
| 5,975,984 | A | 11/1999 | Tart | |
| 5,984,762 | A * | 11/1999 | Tedeschi et al. | 450/86 |
| D423,782 | S | 5/2000 | Ammersman et al. | |
| D448,170 | S | 9/2001 | Ammerman et al. | |
| 6,283,821 | B1 | 9/2001 | Wang | |
| 6,634,923 | B1 * | 10/2003 | Waitz | 450/86 |
| 2003/0040256 | A1 | 2/2003 | Waitz | |

FOREIGN PATENT DOCUMENTS

| | | |
|---|---|---|
| MX | 200951 | 2/1995 |
| MX | 192057 | 6/1996 |

* cited by examiner

CUSHION INSERT FOR STRAPS

BACKGROUND OF THE INVENTION

1. Field of the Invention

The present invention is related to a cushion insert for a strap. More particularly, the present invention is related to straps for a device or garment, such as a brassiere, having a cushion insert.

2. Description of Related Art

Many items require a strap that traverses one or more shoulders of a user to aid in supporting the weight of a carried object. For example, a backpack, a piece of luggage, a briefcase, a purse, a sport equipment bag, and other items can include a strap that traverses a user's shoulder(s)

Additionally, garments such as a medical sling, a brassiere, a woman's bathing suit, a leotard, and other garments, can aid in supporting a portion of a wearer's body. In these applications, the garment can include one or more straps positioned to traverse the wearer's shoulder(s) and, thus, transfer a portion of the supported load to the shoulders.

In order to improve the comfort to the wearer, some straps have included padding, cushioning, and/or load spreading surfaces incorporated into the strap.

However, there is a continuing desire for new and better cushion straps to further increase the comfort of a wearer.

SUMMARY OF THE INVENTION

It is an object of the present invention to provide a cushion insert for a strap.

It is another object to provide a strap that is cushioned with a gel material.

It is yet another object to provide a gel cushioned strap that restrains movement of the gel material away from the body of the wearer.

These and other objects and advantages of the present invention are provided by a cushion insert having a cushion material, a support member, and a cover. The cushion material is enclosed by an upper ply and a lower ply. The support member is disposed on the upper ply. The cover secures the support member to the upper ply so that the support member restrains expansion of the cushion material toward the upper ply.

These and other objects and advantages of the present invention are also provided by a cushioned strap having a first layer facing a first direction and a second layer facing a second, opposite direction. The cushioned strap has a gelatinous cushion enclosed between a first ply and a second ply. The gelatinous cushion is positioned between the first and second layers so that the second ply is adjacent the second layer. The support member is secured on the first ply by a cover, which is adjacent the first layer. The support member restrains movement of the gelatinous cushion in the first direction upon application of a force to the cushioned strap from the second direction.

Further, the objects and advantages of the present invention are provided by a brassiere having a body-encircling portion having, a strap, and a cushion insert. The body-encircling portion has a pair of breast cups for receiving the breasts of a wearer. The strap secures the body-encircling portion across an interface region of the wearer. The cushion insert is disposed at the interface region. The cushion insert has a gel material proximate the interface region and a support member covering the gel material remote from the interface region. Thus, a force applied to the cushion insert by the interface region is restrained from expanding the gel material away from the interface region.

The above-described and other features and advantages of the present invention will be appreciated and understood by those skilled in the art from the following detailed description, drawings, and appended claims.

DETAILED DESCRIPTION OF THE INVENTION

Figure 1:
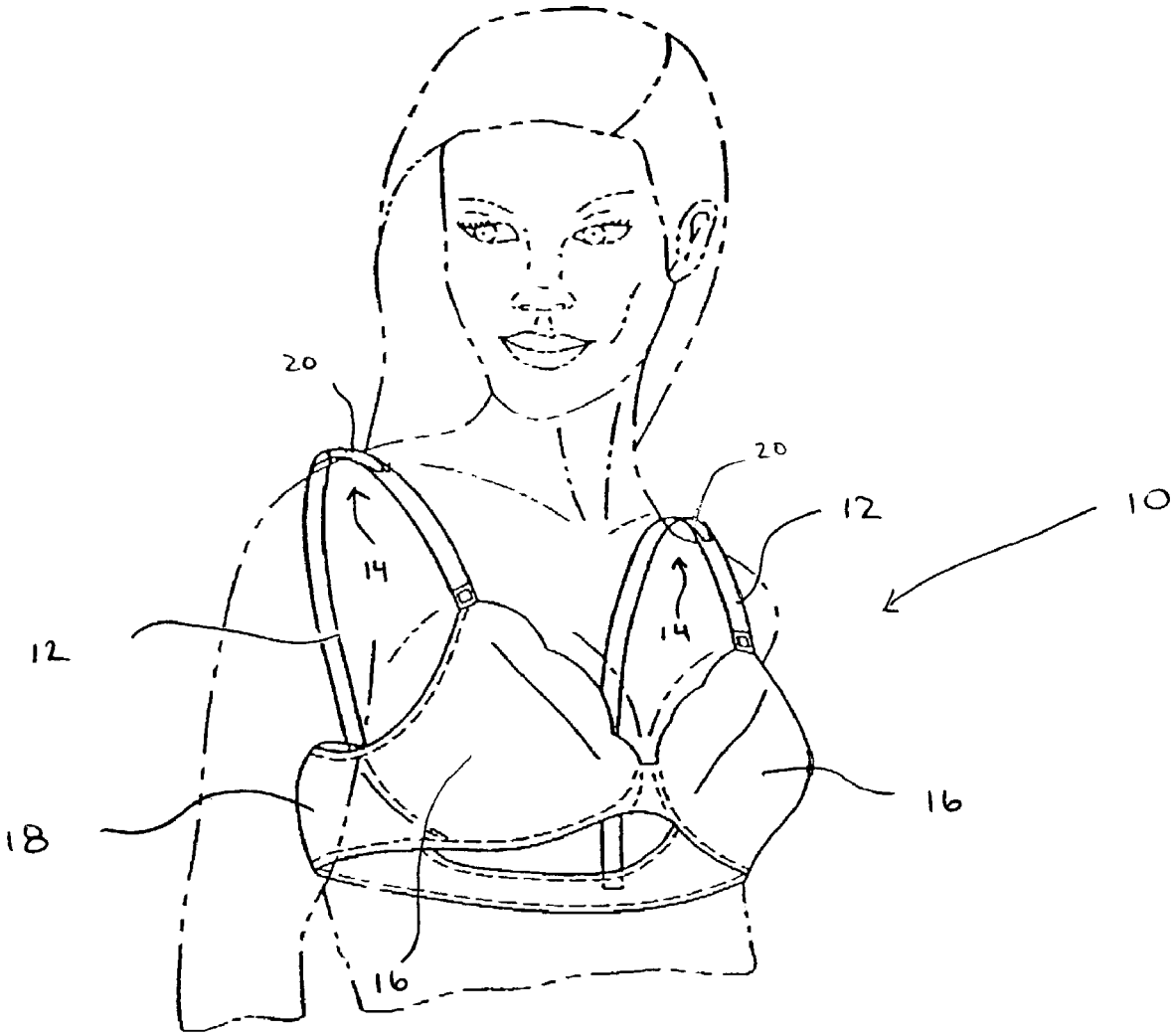
FIG. 1 is a perspective view of an exemplary embodiment of a garment having a cushion strap according to the present invention.

Referring to the drawings and in particular to FIG. 1, a supporting device 10 is illustrated by way of example as a garment, particularly a brassiere. Device 10 includes one or more straps 12 positioned to traverse the shoulder of a wearer at an interface region 14.

In the illustrated embodiment where device 10 is a brassiere, the brassiere includes breast cups 16 defined in a body-encircling portion 18. In use, portion 18 is positioned around the body so that the breasts of the wearer are received in and supported by breast cups 16. In this position, straps 12 transfer a portion of the load supported by device 10 from portion 18 and, thus, cups 16 to interface region 14.

It should be recognized that device 10 is illustrated by way of example as a brassiere having two straps 12 such that interface region 14 is the shoulders of the wearer. Of course, it is contemplated by the present invention for the brassiere to have a single strap 12 that traverse the back of the neck of the wearer (i.e., interface region 14 is the neck of the wearer). Moreover, it is contemplated for interface region 14 to be any support surface such as a shoulder, arm, neck, or other region of the body of the wearer.

In order to cushion the effect of straps 12 on interface region 14, device 10 includes a cushion insert 20 according to the present invention at the interface region.

Figure 2:
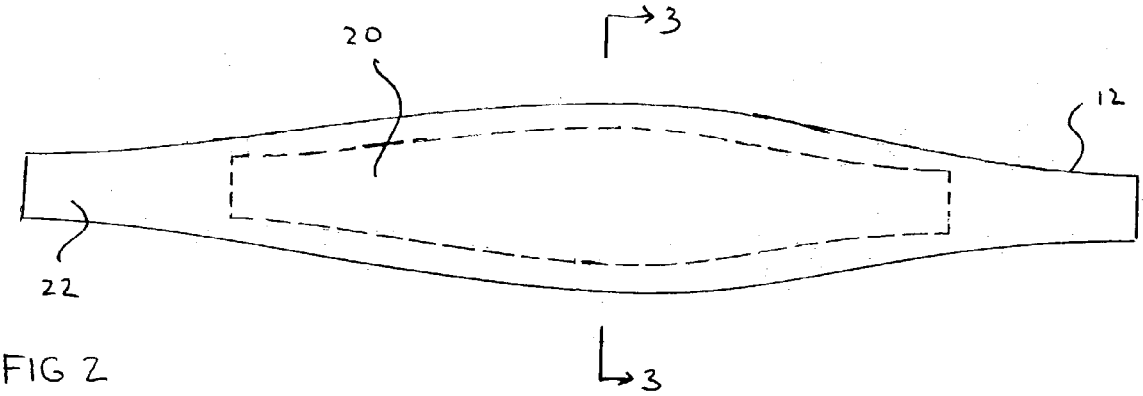
FIG. 2 is top view of the cushion strap of FIG. 1.
Figure 3:
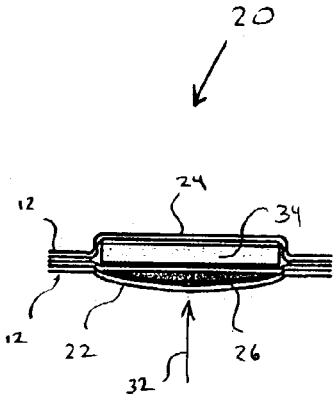
FIG. 3 is a sectional view of the cushion strap taken along lines 3—3 of FIG. 2.
Figure 4:
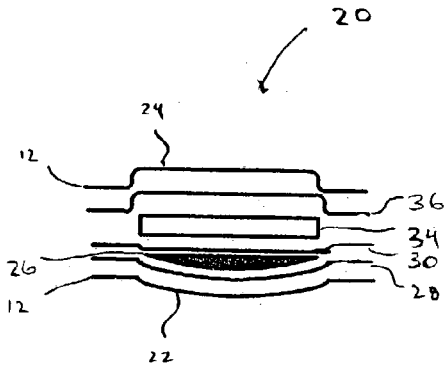
FIG. 4 is an exploded view of FIG. 3.

Cushion insert 20 is described with simultaneous reference to FIGS. 2–4. Insert 20 is a multi-layer structure configured to provide cushioning for region 14, as well as to spread the load of device 10 across a larger area than possible with strap 12 alone.

Insert 20 is, preferably, disposed in strap 12. Specifically, strap 12 has a first layer 22 and a second facing layer 24. First and second layers 22, 24 are, preferably, fabric layers. For example, layers 22, 24 can be formed of fabric made of natural fibers (e.g., cotton), synthetic fibers (e.g., nylon), and any combination thereof.

First layer 22 faces the body of the wearer, while second layer 24 faces away from the body of the wearer. Insert 20 is, preferably, disposed between first and second layers 22, 24, respectively.

Of course, it is contemplated by the present invention for insert 20 to be secured to first layer 22 or second layer 24 of the strap. Alternately, it is contemplated for strap 12 to have only one layer and for insert 20 to be secured to either side of the single layer strap.

Insert 20 includes a cushion material 26, which is, preferably, a gelatinous material. As used herein, "gelatinous" shall mean a semi-solid material having flowable or viscous properties. For example, cushion material 26 can be a silicone gel commercially available from Grupo Empresarial of Columbia and having a brookfield viscosity of about 4100 centipoise (cps) at 25 degrees Celsius. Of course, it is contemplated by the present invention for cushion material 26 to be other gelatinous materials having a higher or lower viscosity.

Cushion material 26 is contained between a lower ply 28 and an upper ply 30 of plastic material. For example, upper and lower plies 28, 30 can be polyvinyl chloride (e.g., PVC).

In use, region 14 applies a force on insert 20 in the direction of arrow 32. It has been found that force 32 causes cushion material 26 to move away from region 14, which can limit the cushioning effects of the cushion material. For example, it has been found that force 32 causes cushion material 26 to exert pressure on upper ply 30 in a direction away from the force, which can cause the upper ply to expand outward away from region 14.

Advantageously, insert 20 includes a support member 34 positioned at upper ply 30. In this position, support member 34 can mitigate the occurrence of cushion material 26 expanding outward away from region 14. Namely, support member 34 can aid in applying a restraining force to cushion material 26 in a direction opposite force 32. Thus, support member 34 has been found to be effective at maintaining the cushioning effects of cushion material 26 to a greater degree than is possible without the support member.

Support member 34 can be formed of a rubber material, such as ethylene vinyl acetate (EVA) rubber. Preferably, support member 34 is an open or closed celled foam EVA rubber material. In addition, support member 34 is, preferably, secured to upper ply 30 with a cover 36. Cover 36 can be the same material as upper and lower plies 28, 30. Alternately, cover 36 can be a different material than upper and lower plies 28, 30.

Accordingly, insert 20 is a multi-layer structure including cover 36, support member 34, upper ply 30, cushion material 26, and lower ply 28. Cushion material 26, preferably, has viscous properties to distribute and cushion force 32 across region 14. In addition, support member 34 aids in mitigating the flow of cushion material 26 outwards away from region 14, which has been found to increase the cushioning effect of the cushion material.

Thus, insert 20 is particularly suited for insertion into and/or securement to strap 12 to easily and quickly render the strap a cushioned strap.

It should also be noted that the terms "first", "second", "third", "upper", "lower", and the like may be used herein to modify various elements. These modifiers do not imply a spatial, sequential, or hierarchical order to the modified elements unless specifically stated.

While the present invention has been described with reference to one or more exemplary embodiments, it will be understood by those skilled in the art that various changes may be made and equivalents may be substituted for elements thereof without departing from the scope of the present invention. In addition, many modifications may be made to adapt a particular situation or material to the teachings of the disclosure without departing from the scope thereof. Therefore, it is intended that the present invention not be limited to the particular embodiment(s) disclosed as the best mode contemplated for carrying out this invention, but that the invention will include all embodiments falling within the scope of the appended claims.

What is claimed is:

1. A cushion insert comprising:

a cushion material being enclosed by an upper ply and a lower ply;

a support member being disposed on said upper ply; and a cover being in contact with said support member to secure said support member to said upper ply so that said support member restrains expansion of said cushion material toward said upper ply, said cover being in contact with said lower ply.

2. The cushion insert of claim 1, wherein said support member is a rubber material.

3. The cushion insert of claim 2, wherein said rubber material is ethylene vinyl acetate rubber.

4. The cushion insert of claim 2, wherein said rubber material is an open celled foam material or a closed celled foam material.

5. The cushion insert of claim 1, wherein said cushion insert is positionable in a strap.

6. The cushion insert of claim 1, wherein said cushion material is a gelatinous material.

7. The cushion insert of claim 6, wherein said gelatinous material is a silicone gel.

8. The cushion insert of claim 3, wherein said gelatinous material has a viscosity of about 4100 centipoise.

9. The cushion insert of claim 1, wherein said upper ply, said lower ply, and said cover are all formed of the same plastic material.

10. A cushioned strap comprising:

a first layer facing a first direction;

a second layer facing a second direction, said second direction being opposite said first direction;

a first ply between said first and second layers, said first ply being adjacent said first layer;

a second ply between said first and second layers, said second ply being adjacent said second layer;

a gelatinous cushion enclosed between said first and second plies; and a support member secured on said first ply, said support member restraining movement of said gelatinous cushion in said first direction upon application of a force to said cushioned strap from said second direction.

11. The cushioned strap of claim 10, wherein said support member is a rubber material.

12. The cushioned strap of claim 11, wherein said rubber material is an open celled foam material or a closed celled foam material.

13. The cushioned strap of claim 10, wherein said second direction faces an interface region of a strap wearer.

14. The cushioned strap of claim 10, wherein said first and second layers are fabric layers formed of a fiber selected from the group consisting of natural fibers, synthetic fibers, and any combination thereof.

15. The cushioned strap of claim 10, wherein said gelatinous material has a viscosity of about 4100 centipoise.

16. A brassiere comprising:

a body-encircling portion having a pair of breast cups defined therein, each of said pair of breast cups for receiving a breast of a wearer;

a strap for securing said body-encircling portion across an interface region of said wearer; and a cushion insert being disposed at said interface region, wherein said cushion insert has a gel material proximate said interface region and a support member only covering the portion of said gel material that is remote from said interface region so that a force applied to said cushion insert by said interface region is restrained from expanding said gel material away from said interface region.

17. The brassiere of claim 16, wherein said support member is a rubber material.

18. The brassiere of claim 17, wherein said rubber material is an open celled foam material or a closed celled foam material.

19. The brassiere of claim 16, wherein said strap comprises a first layer and a second layer and wherein said cushion insert is positioned between said first and second layers.

20. The brassiere of claim 17, further comprising a pair of plies enclosing said gel material, said support member being secured to one of said pair of plies.

* * * * *